US006095597A

United States Patent [19]

Huang

[11] Patent Number: 6,095,597

[45] Date of Patent: Aug. 1, 2000

[54] COLLAPSIBLE CHAIR

[76] Inventor: Tsung-Chieh Huang, No. 1, Ta Yo 2 Street, Ta Fa Industrial District, Kaohsiung Hsien, Taiwan

[21] Appl. No.: 09/296,863

[22] Filed: Apr. 22, 1999

[51] Int. Cl.[7] ..... A47C 4/00

[52] U.S. Cl. ..... 297/58; 297/239

[58] Field of Search ..... 297/239, 55, 56, 297/58, 463.1, 16.1; 248/188.8, 188.9

[56] References Cited

U.S. PATENT DOCUMENTS

| | | |
|---|---|---|
| 2,747,654 | 5/1956 | Chapman et al. . |
| 2,888,775 | 6/1959 | Thoeming . |
| 5,427,342 | 6/1995 | Gagnon . |
| 5,513,900 | 5/1996 | Iglesias . |
| 5,524,966 | 6/1996 | Piretti . |
| 5,785,287 | 7/1998 | Hoshino . |

*Primary Examiner*—Milton Nelson, Jr.
*Attorney, Agent, or Firm*—Pro-Techtor International Services

[57] ABSTRACT

A collapsible chair includes a pivotal member having a lower pivot hole for connecting with an upper portion of two front feet and an upper hole for connecting an upper end of two rear feet. The lower pivot hole and the upper pivot hole are not aligned but on different surfaces. Two touch blocks are respectively fitted around a lower horizontal rod of the two front feet and of the two rear feet. Each touch block has a position edge protruding from a front side or a rear side. A seat is provided with a pivot base at two opposite sides for connecting with the two rear feet, and each pivot base has a recessed flat face respectively in an upper and a lower side. A backrest is provided with an armrest at two opposite sides, and the armrest has an acute angle member formed under it. Then the collapsible chair is safe and stabilized in an extended condition, and safe and steady and space-saving in a collapsed piled-up condition.

3 Claims, 10 Drawing Sheets

COLLAPSIBLE CHAIR

BACKGROUND OF THE INVENTION

This invention relates a collapsible chair, particularly to one collapsible to be piled up one by one very closely to each other, possible to be stored in a small space and in a stabilized position.

There are many kinds of collapsible chairs in market and in use, such as those made of wood or metal. As wood has become harder and harder to get these days, a large number of collapsible chairs are almost made of metal. In early days, metal collapsible chairs have been made of metal rods and metal plates, made much of its enduring and strong characteristics, but comfort to sit on and space for storing them are considered not so important. But as living standard has been growing high and high, conventional collapsible chairs are not so welcomed owing to their less comfort and large space needed to store them.

SUMMARY OF THE INVENTION

This invention has been devised to offer a collapsible chair possible to be expanded for use in a safe and stabilized condition, and safe and steady and space-saving when a number of the collapsed chairs are piled up for storing.

One feature of the invention is pivotal members pivotally connecting with two front feet and two rear feet for expanding and collapsing the front and the rear feet.

Another feature of the invention is a seat pivotally connected with the front feet and the rear feet for collapsing.

Another feature of the invention is a backrest additionally provided with an armrest at two opposite sides, and further an acute angle member is provided under each armrest for engaging each other to keep the piled-up collapsed chairs in a stabilized condition when a number of collapsed chairs are piled up.

One more feature of the invention is two touch blocks fitted around a lower horizontal rod connecting respectively the two front feet and the two rear feet to keep the chair from slipping on the ground and contactint each other to assist to keep the piled-up collapsed chairs stabilized, when a number of collapsed chairs are piled up for storing.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
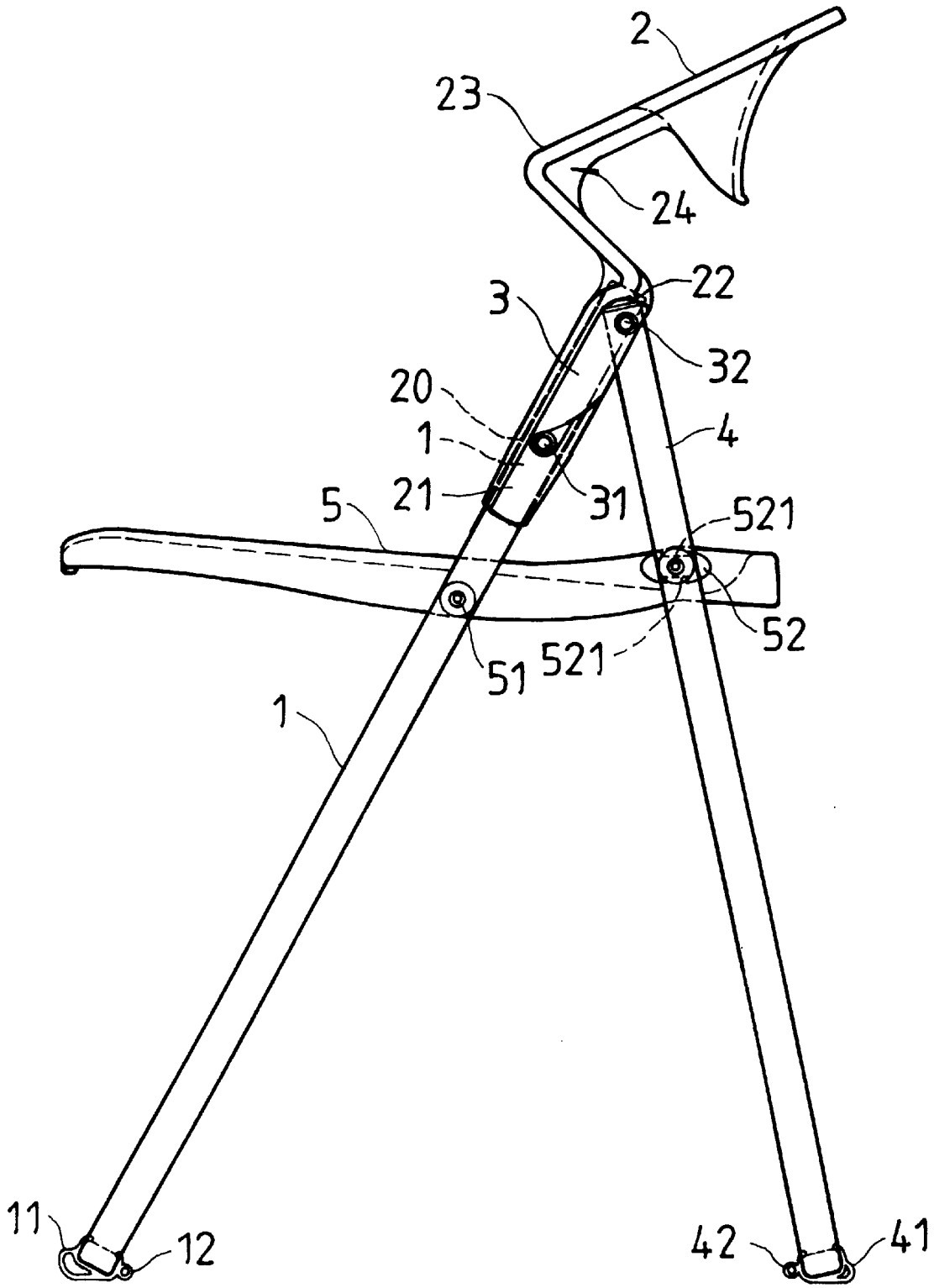
FIG. 1 is a side view of a collapsible chair in the present invention.
Figure 2:
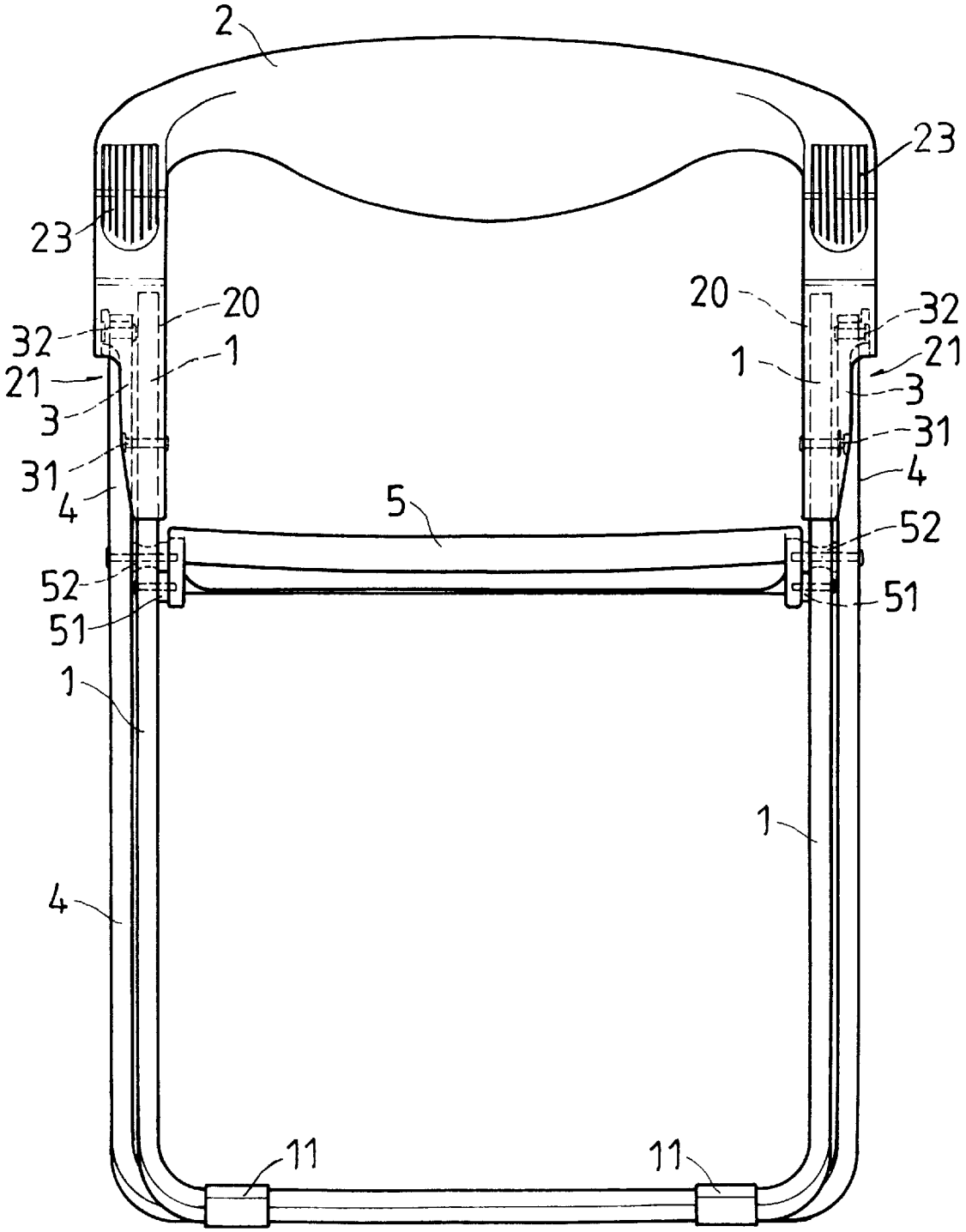
FIG. 2 is a front view of the collapsible chair in the present invention.
Figure 3:
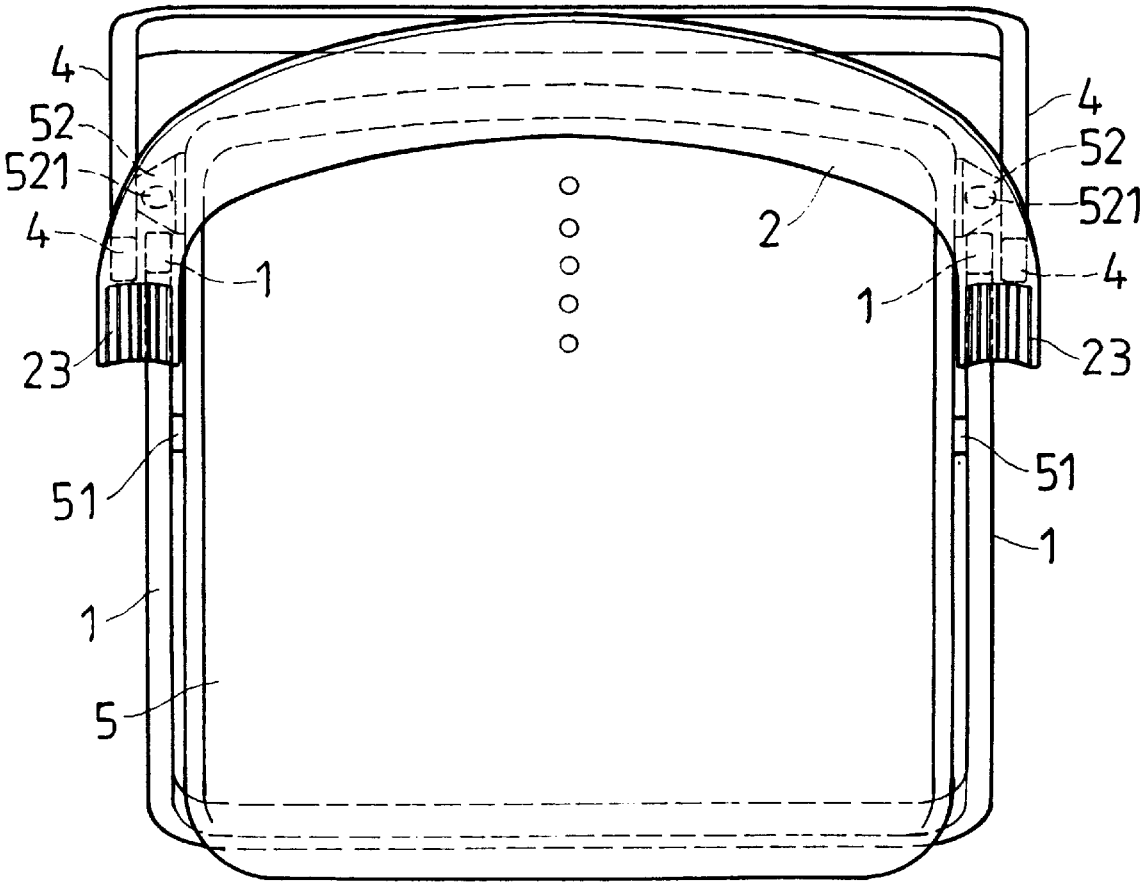
FIG. 3 is an upper view of the collapsible chair in the present invention.
Figure 5:
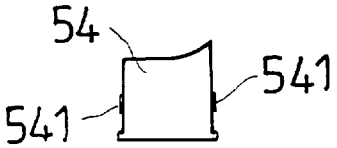
FIG. 5 is an upper view of FIG. 4.
Figure 7:
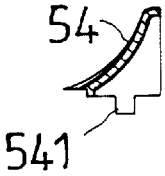
FIG. 7 is a cross-sectional view of line 7—7 in FIG. 4.
Figure 4:
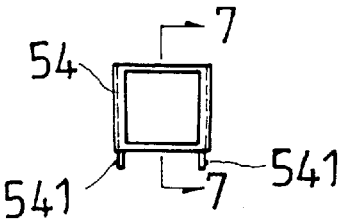
FIG. 4 is a front view of a decorative cover of a seat in the collapsible chair in the present invention.
Figure 6:
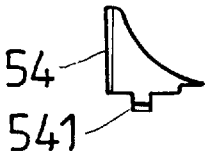
FIG. 6 is a right side view of FIG. 4.
Figure 9:
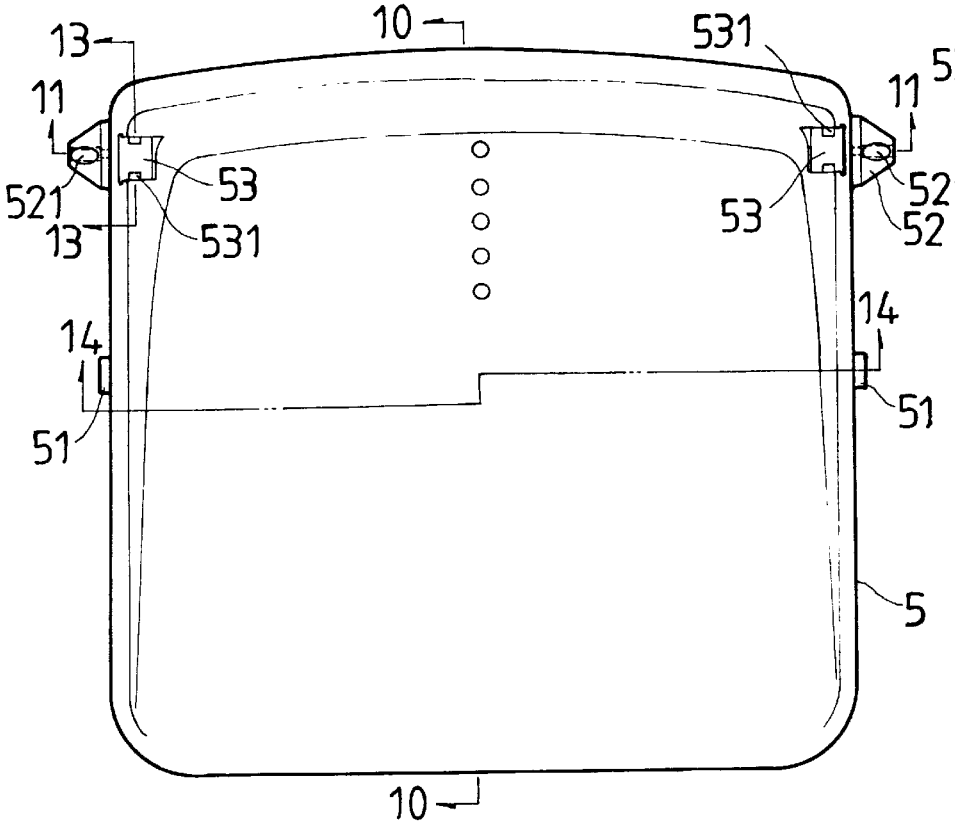
FIG. 9 is an upper view of FIG. 8.
Figure 10:
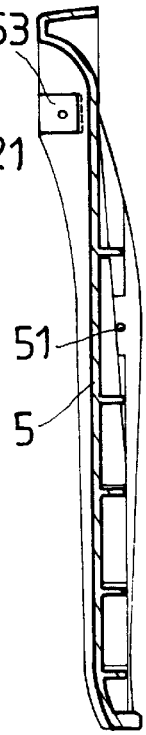
FIG. 10 is a cross-sectional view of line 10—10 in FIG. 9.
Figure 8:
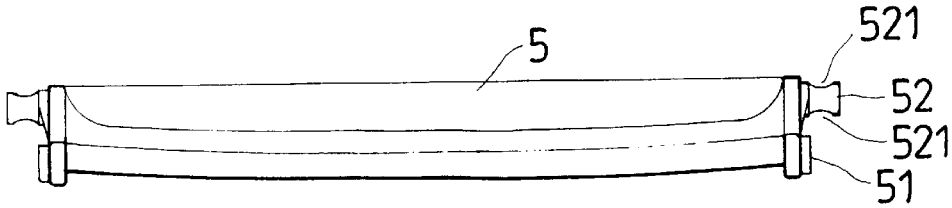
FIG. 8 is a front view of a seat in the collapsible chair in the present invention.
Figure 11:
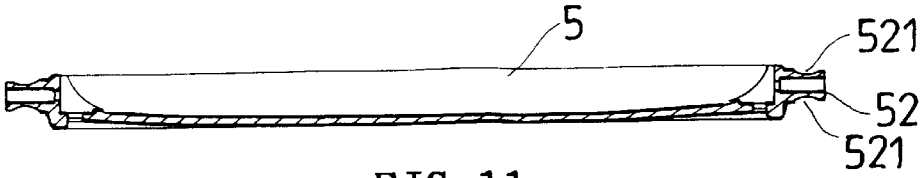
FIG. 11 is a cross-sectional view of line 11—11 in FIG. 9.
Figure 12:
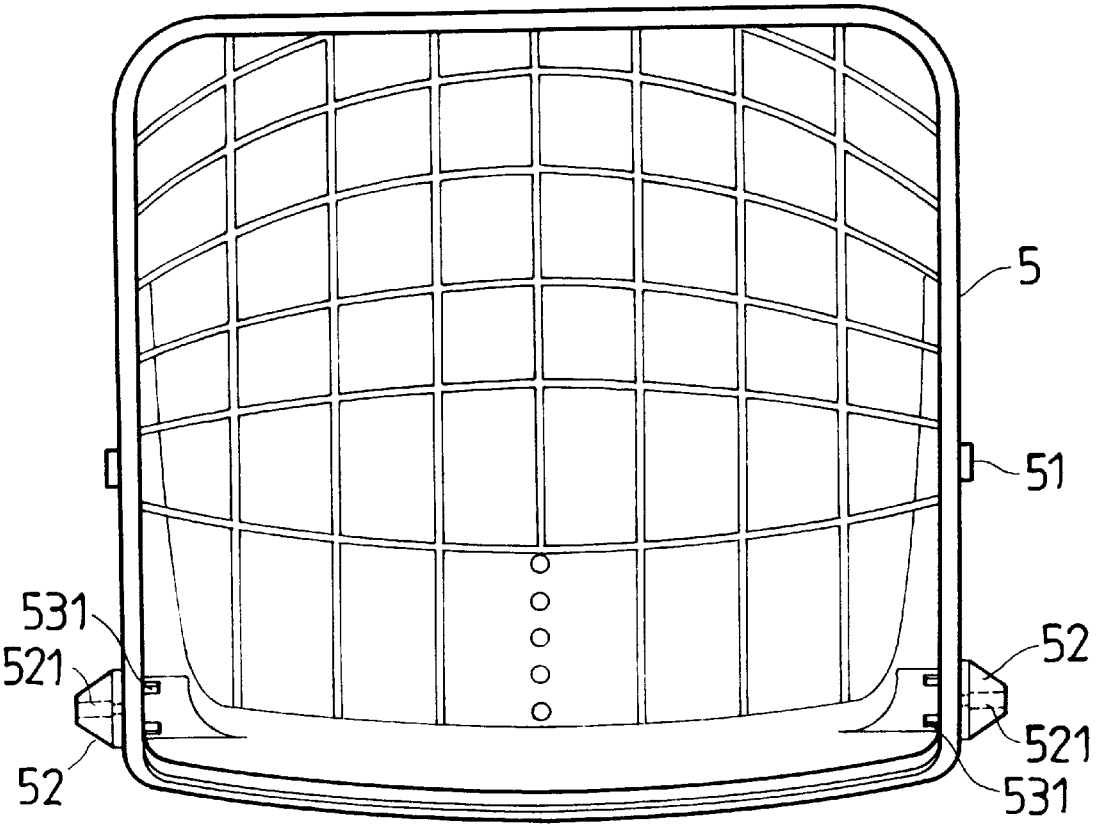
FIG. 12 is an upper view of FIG. 8.
Figure 13:
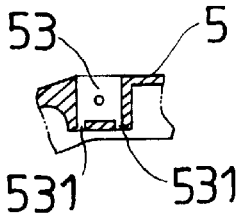
FIG. 13 is a cross-sectional view of line 13—13 in FIG. 9.
Figure 14:
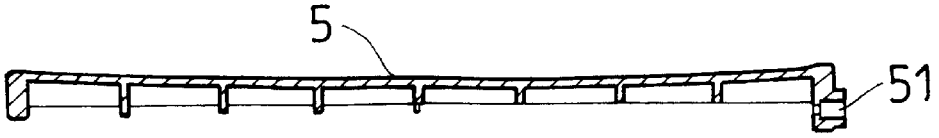
FIG. 14 is a cross-sectional view of line 14—14 in FIG. 9.

A preferred embodiment of a collapsible chair in the present invention, as shown in FIGS. 1, 2 and 3, includes front feet 1, a backrest 2, two pivotal member 3, rear feet 4 and a seat 5 as main components combined together.

Figure 28:
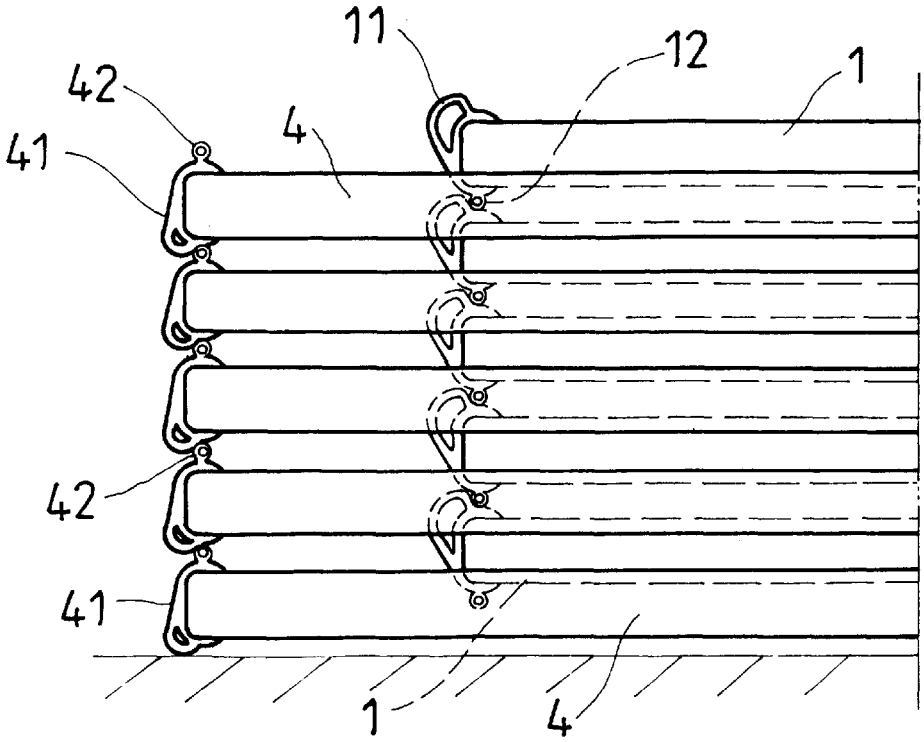

The front feet 1 are U-shaped, connected with a lower horizontal rod, respectively having an upper portion inserted in a cylinder 20 of the backrest 2 with bolts screwed tightly the both together. In addition, one end of the pivotal member 3 is connected with a pivot at an outside of the front feet 1, to permit the pivotal member move with the pivot. Further, an intermediate portion of the two front feet 1 is connected with the pivot hole 51 respectively in the two sides of the seat 5, permitting the seat 5 swing upward and backward between the two front feet 1. The lower horizontal rod connecting the two front feet 1 has at least two touch blocks 11 fitting around on. Each touch block 11 has a position edge 12 extending back from a rear side, as shown in FIG. 28, with the ground-touching surface forming a slope with the horizontal rod of the front feet 1. The ground-touching surface of each touch block 11 has a larger dimensions than that of its upper surface.

Figure 15:
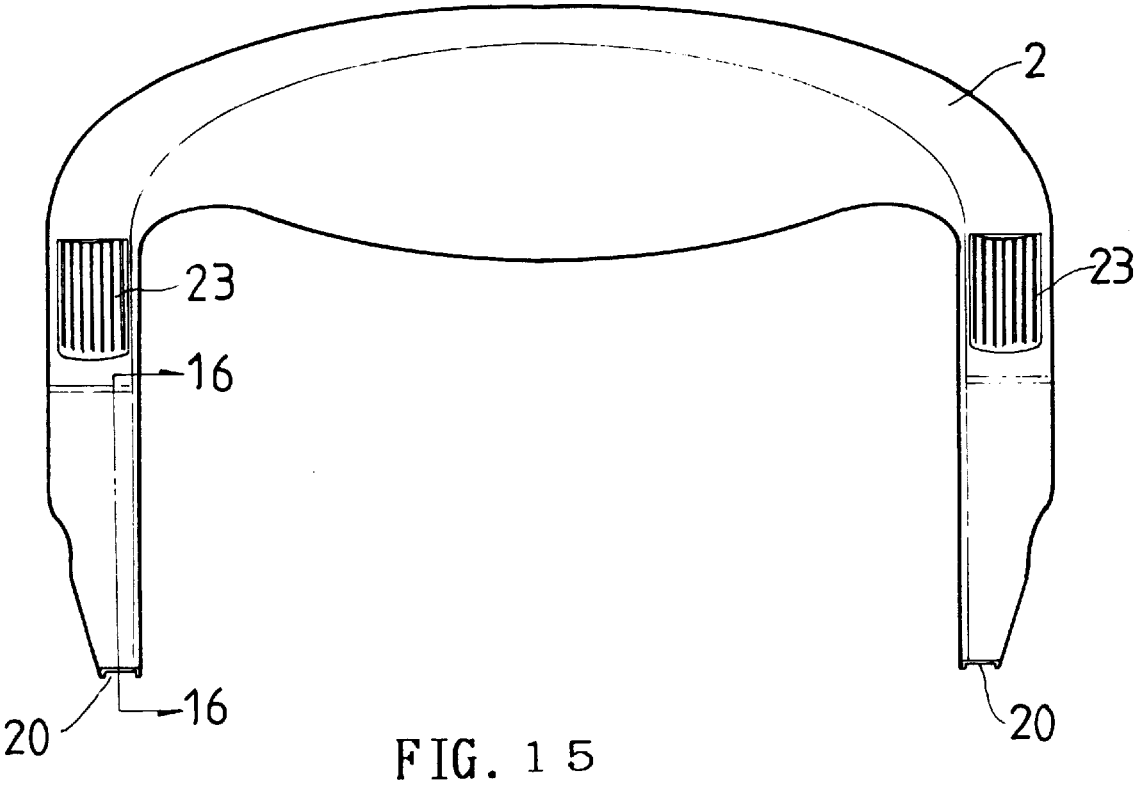
FIG. 15 is a front view of a backrest in the collapsible chair in the present invention.
Figure 16:
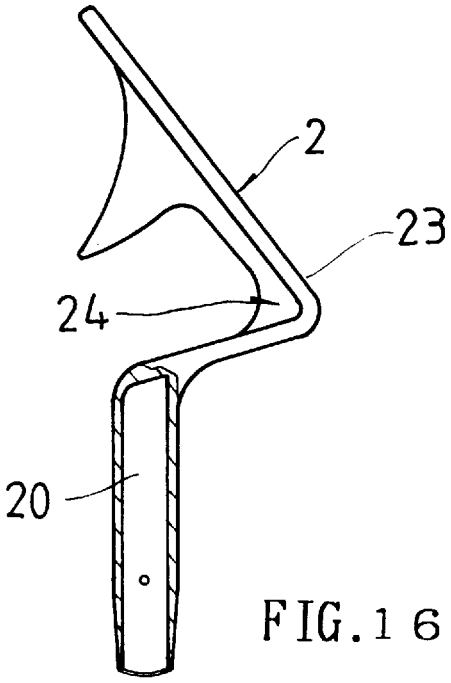
FIG. 16 is a cross-sectional view of line 16—16 in FIG. 15.
Figure 20:
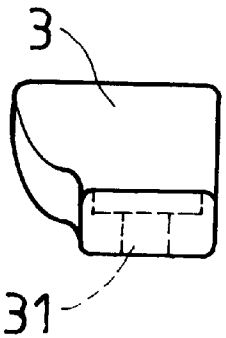
FIG. 20 is an upper view of FIG. 8.
Figure 18:
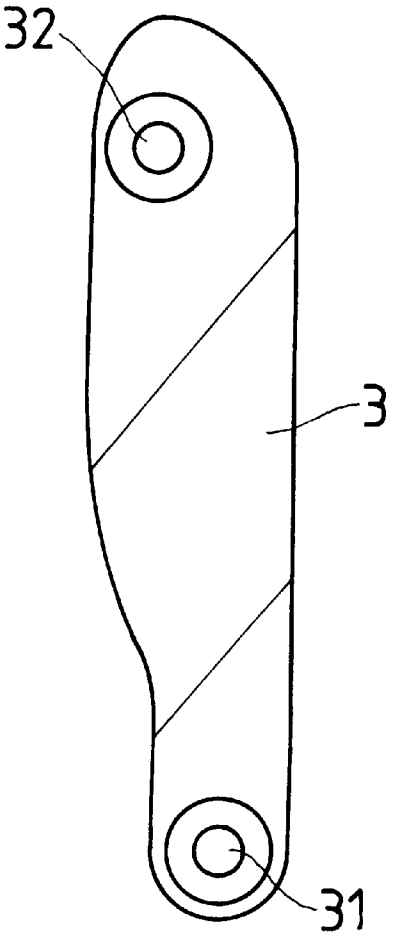
FIG. 18 is a right side view of FIG. 17.
Figure 17:
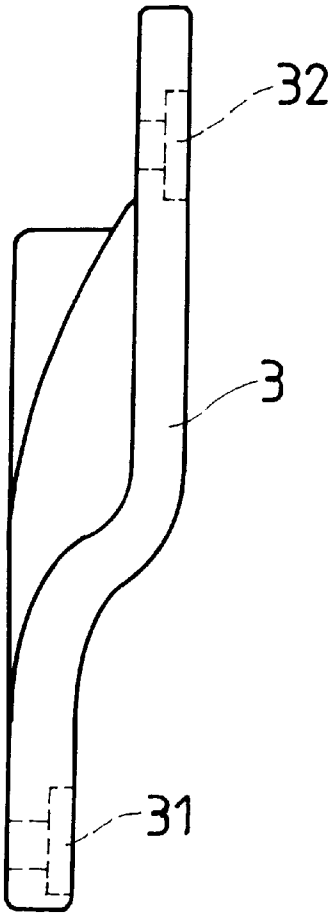
FIG. 17 is a side view of a right pivotal member in the collapsible chair in the present invention.
Figure 19:
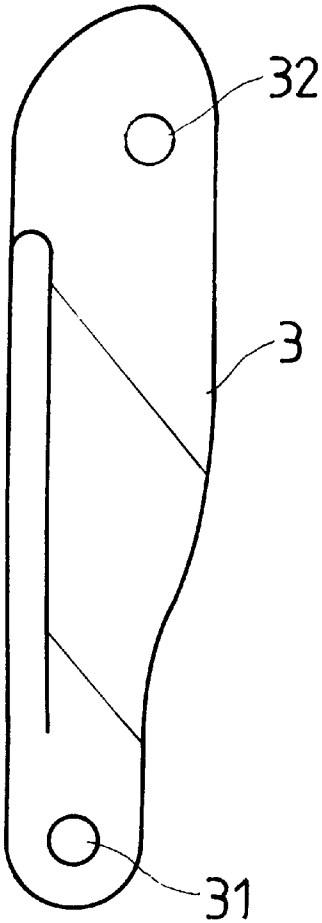
FIG. 19 is a left side view of FIG. 17.
Figure 23:
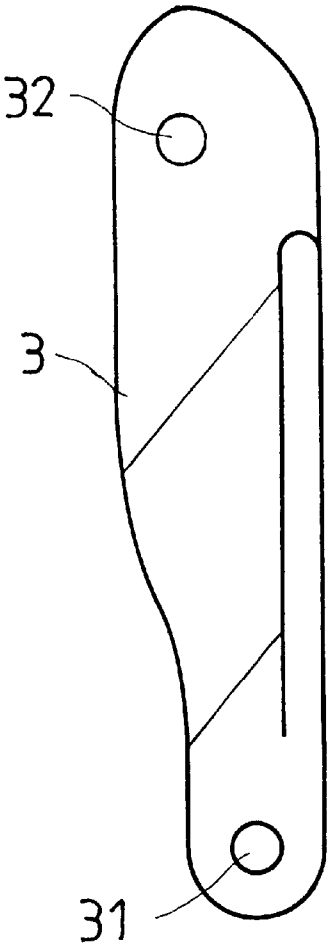
FIG. 23 is a left side view of FIG. 21.
Figure 21:
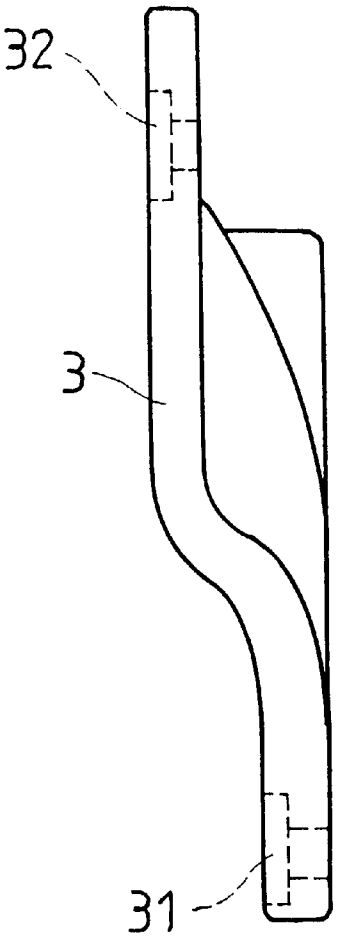
FIG. 21 is a side view of a left pivotal member in the collapsible chair in the present invention.
Figure 22:
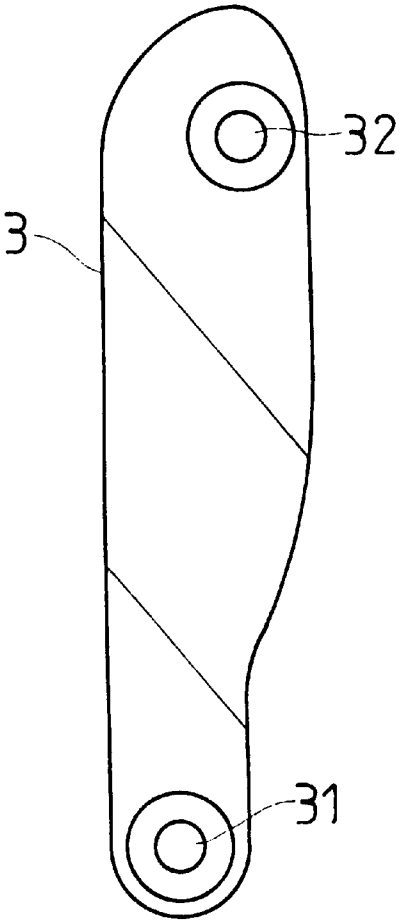
FIG. 22 is a right side view of FIG. 21.
Figure 24:
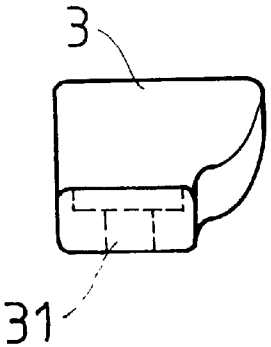
FIG. 24 is an upper view of FIG. 22.
Figure 26:
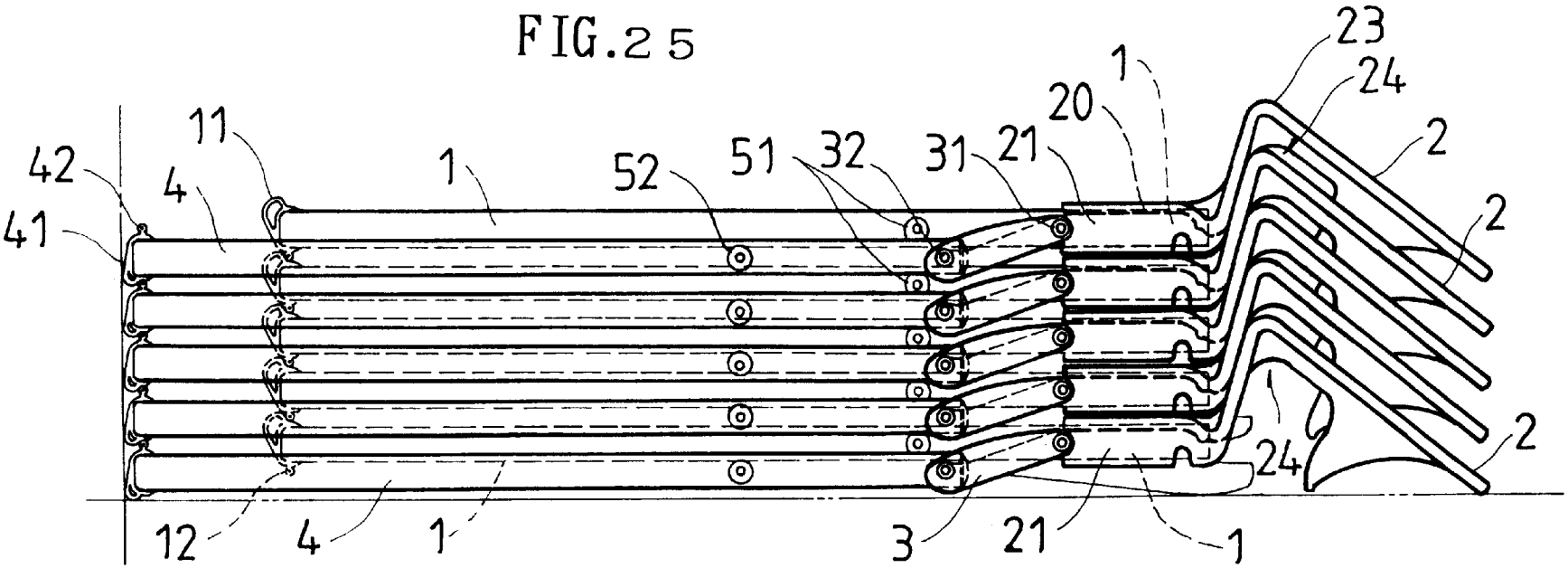
FIG. 26 is a side view of a number of the collapsible chairs in the present invention collapsed and piled up one on one.

As shown in FIGS. 15 and 16, the backrest 2 has not only a curved shape to suit the back of a person, but also an armrest 23 respectively formed integral at two opposite side. Further, a curved position member 24 is formed extending rearward and downward under each armrest 23, so a side view of each armrest 23 looks like an acute angle. This acute-angle section can be utilized to permit the backrests 2 pile one by one in a stabilized condition when a number of the collapsible chairs are piled up, as shown in FIG. 26. Further, in addition to the cylinders 20 formed in two sides of the backrest 2, an open space 21 is formed at two sides of the backrest 2 for the two rear feet 4 to move in and out. And an engage edge 22 is formed at a front upper wall of the open space 21 for engaging the upper end of the rear feet 4 when expanded out, as shown in FIG. 1.

The pivotal members 3, as shown in FIGS. 17–24, have a right side one and a left side one of the same structure but symmetrical to each other. Each pivotal member 3 has an upper and a lower pivot hole 32 and 31 not aligned on the same surface owing to its curved shape, with the surface difference of the two pivot 31, 32 being at least thick as the thickness of the rear feet 4 viewed from the front side. The lower pivot hole 31 is located at the outside of the front feet 1, and the upper pivot hole 32 is located at the outside of the rear feet 4.

Figure 25:
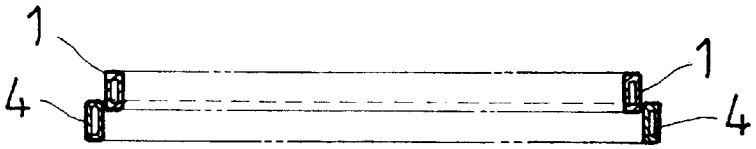
FIG. 25 is a side view of front feet and rear feet collapsed in the present invention.

The rear feet 4 are also U-shaped, connected with a lower horizontal rod, having upper ends pivotally connected to and inside the upper pivot hole 32 of the pivotal members 3. The distance between the two rear feet 4 is longer than that between the two front feet 1 as shown in FIG. 25. The two rear feet 4 have an intermediate portion of two opposite sides connected to the pivot base 52 of the seat 5. Two touch blocks 41 are fitted around the lower horizontal rod of the two rear feet 4. Each touch block 41 has a ground-touching surface forming an angle with the lower horizontal rod of the rear feet 4, and the dimensions of the ground-touching surface is larger than that of the upper surface.

Figure 27:
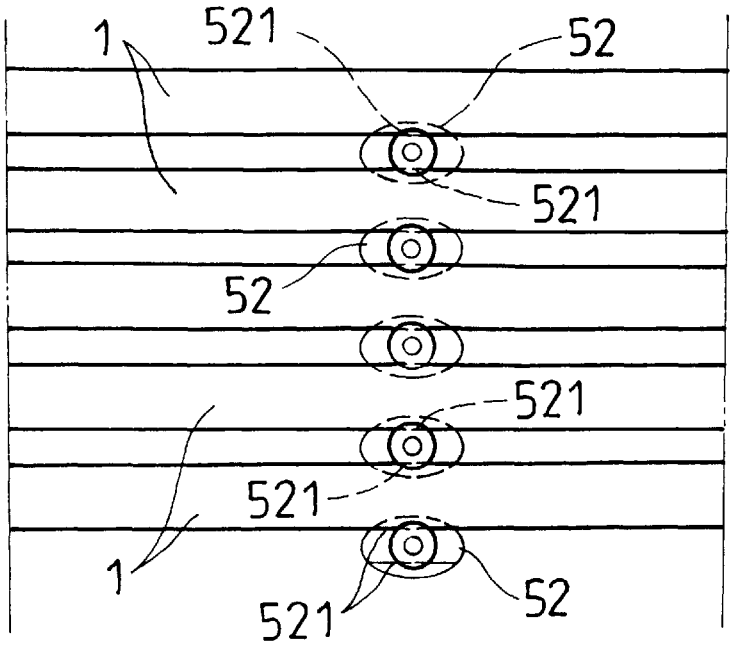
FIG. 27 is a side view of the front feet and pivotal members resting with each other when a number of the collapsible chairs are piled up in the present invention; and, FIG. 28 is a side view of the front feet and the rear feet resting with each other when a number of the collapsible chairs are piled up in the present invention.

The seat 5, as shown in FIGS. 8–14, has a pivot hole 51 formed in an intermediate portion of two opposite sides, and a pivot base 52 of an oval shape formed to protrude out of the rear ends of the two opposite sides. The outer end of each pivot base 52 rests against the inner sides of the rear feet 4, with a bolt passing through the pivot base 52 to secure the seat 5 with the two rear feet 4. Further, each pivot base 52 has a recessed flat face 521 formed on an upper and a lower side so that the front feet 1 may rest thereon stabilized when a number of collapsed chairs are piled up, as shown in FIG. 27. Further, the seat 5 is provided with a combine hole 53 inside the pivot base 52 for a bolt to be easily screwed to combine the rear feet 4 with the seat 5. A decorative cover 54 shown in FIGS. 4–7 is provided to have a projection 541 at two sides to fit in two holes 531 of the engage hole 53 for covering the combine hole 53.

The collapsible chair in the invention has the following practical effects. FIGS. 1, 2, 26, 27, and 28 are to be referred to.

1. When the collapsible chair is extended out, the front and the rear feet are moved relative to each other by means of the pivotal members, and the upper ends of the rear feet are positioned under the two sides of the armrest, stabilizing the extended condition of the chair.

2. When the chair is collapsed, the lower side of the front feet rests on an upper side of the rear feet, and the front feet and the rear feet overlap with each other (overlapping about 0.5 cm. and decreasing height about 1 cm after collapsed), thus effectively decreasing the whole height and space when a number of collapsed chairs are piled up.

3. When plural collapsed chairs are piled up, the front and the rear feet of an upper chair may overlie the front and the rear feet of a lower chair, as shown in FIGS. 26 and 28, increasing safety and stability of the piled up chairs.

4. When plural collapsed chairs are piled up, the recessed flat faces of the pivot bases of the seat of each chair serve the front feet of an upper chair and a lower chair to rest against, so the piled chairs are positioned in a stabilized and steady condition.

5. When plural collapsed chairs are piled up, the touch blocks 11, 41 of the front and the rear feet have their protruding position edges 12 and 42 resting against each other so as to prevent the collapsed chairs from moving, thus functioning to assist to stabilize them.

6. When plural collapsed chairs are piled up, the acute-angle bent position members around the armrests rest on each other, functioning to assist to stabilize them as well, as shown in FIG. 26.

7. The chair in the invention is comfortable and steady to sit on, and can be collapsed and piled up in a stabilized and safe condition and in a very small space as well. For example, if one chair decreases 1 cm. then ten chairs can save 10 cm in the piled height. The chair in the invention surely surpasses conventional collapsible chairs in the piling up condition.

While the preferred embodiment of the invention has been described above, it will be recognized and understood that various modifications may be made therein and the appended claims are intended to cover all such modifications which may fall within the spirit and scope of the invention.

What is claimed is:

1. A collapsible chair comprising two front feet, two rear feet, a backrest fixed on upper ends of said front feet, a pivotal member pivotally connected to each said front foot and each said rear foot, a seat having two opposite sides pivotally connected with said front and said rear feet, at least two front touch blocks fitted around a first lower horizontal rod connecting said two front feet, and at least two rear touch blocks fitted around a second lower horizontal rod connecting said two rear feet; said two front feet and said first lower horizontal rod form a U shape and have upper portions extending in a cylinder formed in two opposite sides of said backrest, said upper portions are secured with bolts, said pivotal members connected to each said front foot having one end positioned outside each said front foot to permit said pivotal members to pivot, each of said two front feet having an intermediate portion pivotally connected with two opposite sides of said seat, each said touch block fitted around said lower horizontal rods having a protruding-back engaging edge extending from a rear edge and a ground-touching surface forming an angle with a respective lower horizontal rod, said ground-touching surface of each said touch block being larger than that of an upper surface thereof; said backrest forms a curve conforming to a back of a person and having an armrest formed at two opposite sides and a bent position member formed under each said armrest, said bent position member allowing said backrest to be stabilized when a plurality of said collapsible chairs are stacked in a collapsed position, said backrest further having a cylinder extending from a lower end of each said armrest to receive an upper portion of said two front feet therein, said backrest further having an open space formed in two opposite sides for said two rear feet to move in and out of, an engaging edge formed on a front upper side defining each said open space for two upper ends of said two rear feet to rest against when said rear feet are extended;

said pivotal members having a left pivotal member and a right pivotal member, said left pivotal member and said right pivotal member are symmetrical, each said pivotal member having an upper and a lower pivot hole separated by a distance not less than a width of said rear feet, each said lower pivot hole is secured with a bolt, and each said upper pivot hole is secured with a bolt;

said two rear feet and said second lower horizontal rod form a U shape, said two rear feet each having an upper end positioned with a bolt at an inner side of said pivot hole of each said pivotal member, a distance between said two rear feet being longer than a distance between said two front feet, said two rear feet are connected with a pivot base formed at two opposite sides of said seat; and, said seat having a pivot hole in an intermediate portion of each of two opposite sides for pivotally connecting said two front feet, said seat having a pivot base near a rear end of said two opposite sides with said rear feet, each said pivot base having a recessed flat face on both an upper and a lower surface, said upper and lower recessed flat faces supporting front feet of an adjacent chair when a plurality of said collapsible chairs are stacked in said collapsed condition.

2. The collapsible chair as claimed in claim 1, wherein said seat has a connecting hole formed inside each said pivot base for a bolt to connect said pivot base with said rear feet, and a decorative cover is provided to cover said connecting hole by means of two projections under a bottom, said two projections fitting in two holes beside said connecting hole.

3. The collapsible chair as claimed in claim 1, wherein each said pivot base has an oval shape.

* * * * *